United States Patent [19]

Ibarra

[11] Patent Number: 4,694,755

[45] Date of Patent: Sep. 22, 1987

[54] SHELL FOR FIRING PRACTICE

[75] Inventor: Inigo A. Ibarra, Vizcaya, Spain

[73] Assignee: Esperanza y Cia, S.A., Spain

[21] Appl. No.: 849,751

[22] Filed: Apr. 9, 1986

[51] Int. Cl.[4] ..... F42B 13/22

[52] U.S. Cl. ..... 102/445; 102/372; 102/498; 102/204

[58] Field of Search ..... 102/204, 372, 373, 445, 102/498, 529, 532, 458; 81/3.05

[56] References Cited

U.S. PATENT DOCUMENTS

| | | | |
|---|---|---|---|
| 1,887,990 | 11/1932 | Brownsdon et al. | 102/458 |
| 1,899,925 | 3/1933 | Brofelth | 102/532 |
| 3,274,935 | 9/1966 | Stadler et al. | 102/445 |
| 3,333,539 | 8/1967 | Stahlmann et al. | 102/372 |
| 3,618,250 | 11/1971 | Grandy | 102/446 |
| 3,710,717 | 1/1973 | Tamplen | 102/204 |
| 3,948,179 | 4/1976 | Gawlick et al. | 102/529 |
| 4,098,190 | 7/1978 | Gawlick et al. | 102/445 |
| 4,549,487 | 10/1985 | Jensen | 102/445 |

*Primary Examiner*—Harold J. Tudor

*Attorney, Agent, or Firm*—Lucas & Just

[57] ABSTRACT

Shell for firing practice comprised of a master projectile in the form of a conventional shell which has a hole along its entire axis for the purpose of inserting inside a small bore projectile that comprises a sleeve and in whose inside there is concentrically placed in axial continuity, a cartridge positioned on the bottom of the sleeve which has a first explosive charge that is activated by the mortar firing pin, and where said cartridge possesses a wad having at least one hole to allow the expansive wave to be transmitted to a second firing pin which activates a second explosive charge, and means for transmitting the impelling action of said second charge to a carried projectile.

10 Claims, 3 Drawing Figures

SHELL FOR FIRING PRACTICE

Firing ranges generally used for troop training are usually small in size and mortar firing involves difficulties when using normal large bore projectiles.

In order to mitigate this difficulty, and moreover to achieve minimal weight and volume to facilitate handling and transport to a maximum, a combined unit of two projectiles coupled together has been achieved. The larger bore projectile acts as the master or carrier for a small bore one whose diameter, size and weight are similar to those found in an ordinary habitual mortar shell.

Said subcaliber projectile, constructed in the form of a cartridge, is attached onto the master projectile. Upon being fired, it strikes the target as previously established by means of a range table, while the master projectile lands at a distance of less than 25 meters from the mortar, which means that it can be used for an indefinite number of shots.

Figure 1:
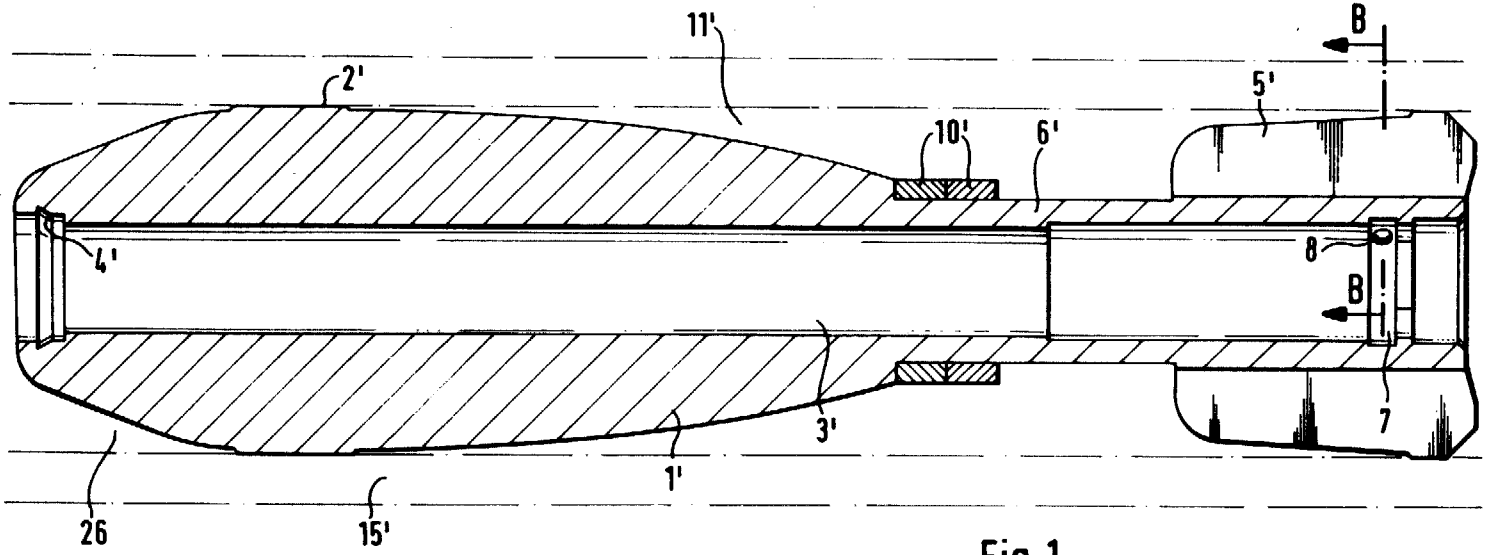
FIG. 1 is a axial section view of the master projectile of the firing practice shell.
Figure 2:
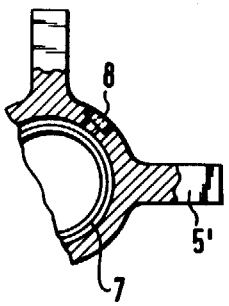
FIG. 2 is a side diagrammatice view on section B:B in FIG. 1.
Figure 3:
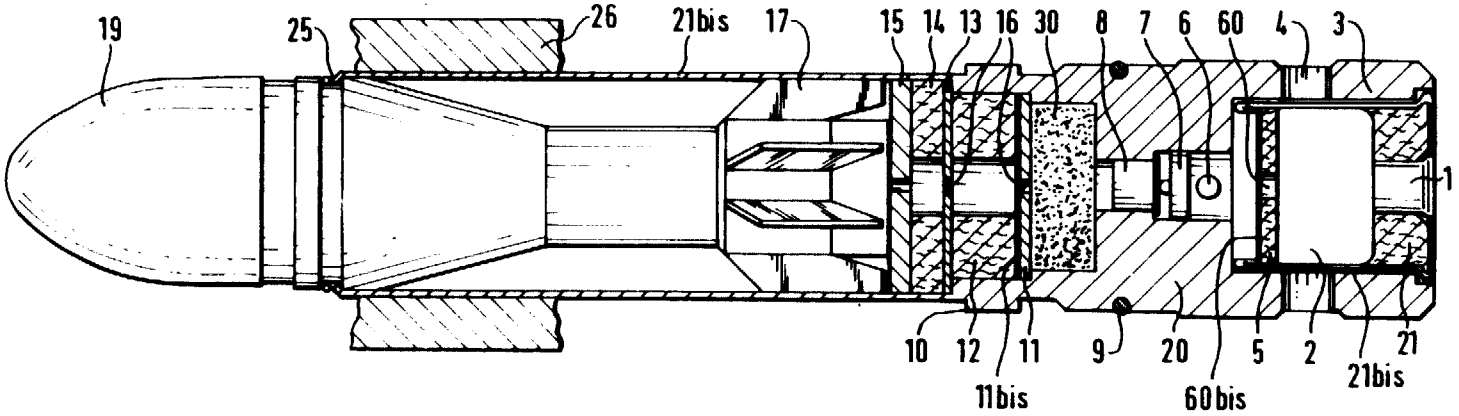
FIG. 3 is an axial section view of the subcaliber projectile.

The master projectile (26) is the same shape as a conventional shell, because it has to be inserted into and fired from a conventional mortar.

Said projectile (26) is comprised of a body (1') with a tail zone (6') and some fins (5').

Protruding girdles (2') may be seen upon the body (1'), and these are for driving the master projectile.

Projectile (26) possesses a hole (3') running along its entire longitudinal axis, the purpose of which is to provide for the loading and firing of a subcaliber projectile (21 bis) for training or practice purposes.

The subcaliber projectile (21 bis) is incorporated into a recoverable sheath or sleeve (20) (not shown) which must be attached to the inside rear of the master projectile (26). Such attachment may be achieved by a screwed thread of any kind, or some other equivalent fix and release means such as shown in the drawings, on the inside groove (7') where sheath (20) is attached in the fashion of a bayonet and abuts the edge of a screw inserted through the hole (8').

In order to ensure that the trainee gets into the habit of placing the war charges into the tail of the shells, this master projectile is also provided with a number of fix and release flexible supplementary pieces (10') which, after firing, will either remain on the master shell or drop onto the ground close to the muzzle of the gun in readiness for reuse.

The employment of these supplementary pieces appears more real in training because of their likeness to those fitted onto ordinary shells.

To cover the hypothetical event of a failure to fire, the front inside of the axial hole is provided with tapered section grooves (4') to allow the master projectile (26) to be withdrawn together with the subcaliber projectile (21 bis) with no movement whatsoever of the weapon, and without any hazard to the user.

After the detonation has been fired, the gases therefrom in said sheath travel between the fins (5') into a space (11') located between the master projectile and the mortar (15') and cause said master projectile (26) to be ejected.

The subcaliber projectile is essentially comprised of a recoverable sleeve (20) which is inserted into the inside of a master projectile (26) and this in turn is inserted into the barrel of a mortar.

Since this sleeve (20) is the carrier of carried projectile (19), when the weapon is fired, the master projectile (26) will fall to the ground at a range of some 25 meters from the muzzle of the mortar, whilst the carried projectile (19) will fall at a range in proportion to the established firing elevation angle. Hence, the master projectile (26) can be picked up, and the empty sleeve (20) removed therefrom, whereupon both are ready for reuse, although in practice only the master projectile (26) is in fact reused.

Sleeve (20) is approximately cylindrical in shape and possesses an approximately hollow portion to accommodate the carried projectile (19), and an approximately solid portion, which nevertheless has a number of concentric and staggered holes to accommodate the different operating components.

Into the rear of sleeve (20) is inserted a cartridge (21) which possesses a cap (1) whose firing is accomplished by the mortar firing pin.

The explosive charge (2) in this cartridge (21) causes the side walls (21 bis) of same to rupture in the areas that lie over the holes (4) in the sleeve (20).

The energy from this explosion drives the master projectile (26) out of the barrel of the mortar (15).

Cartridge (21) also has a wad (5) with a hole (60) that is sealed by a disc (60 bis) made of thin breakable material, and it is through this wad that the expansive wave from this first explosion impels a second firing pin (7) which is capable of sliding in its housing, where the length of its stroke is governed by the presence of a pin (6).

Firing pin (7) strikes the cap (8), which activates a second mass of explosive (30).

The action of this second mass impels a ring (11) made of cardboard, aluminum or other material whose density is not excessively high, and which is reasonably stiff, and this in turn impels a felt wad (12), followed by another aluminium ring (15), where moreover, the purpose of all this assembly is, in addition to impelling, to facilitate attachment at the time when it is assembled, because of its pliability.

The joint between the carried projectile (19) and the sleeve (20) is accomplished by means of a deformation (25) on the upper edge of said sleeve (20) which is inserted into a groove on the carried projectile (19).

The various wads and discs mentioned (11, 12, 12, 14 and 15) have at least one hole (16) which allows the ignition of a third explosive charge inside the carried projectile.

Hole (16) in disc (11) is sealed by means of a thin self-adhesive disc (11 bis) which prevents the explosive mass (30) from leaving its housing.

Externally the recoverable sleeve (20) possesses a screwed thread or a set of lugs (10) to enable it to be inserted by screwing or in the manner of a bayonnet into the inside of the master projectile (26).

There is also provided a gasket (9) which serves the purpose of achieving a good fit and seal.

I claim:

1. A shell for firing practice comprising:

(a) a master projectile in the shape of a conventional shell, said master projectile having a bore along the longitudinal axis of said master projectile;

(b) a subcaliber training projectile, said subcaliber trainign projectile comprised of a sleeve and a plurality of components that are housed in said sleeve, said subcaliber training projectile capable of fitting inside said master projection bore;

($b_1$)said sleeve housing said components such that said components are concentrically placed in axial continuity inside said sleeve in the following order from one end of said sleeve to the other;

($b_{1-1}$) a cartridge positioned at one end of the sleeve said cartridge having a first explosive charge that is activated by a mortar firing pin, and said cartridge having a wad with at least one hole therethrough, said first explosive charge capable of producing a first explosion;

($b_{1-2}$) a second firing pin positioned next to said cartridge inside said sleeve, said second firing pin capable of being acted upon by said first explosion by means of said hole in said wad;

($b_{1-3}$) a second explosive charge which is capable of being activated by said second firing pin, said second explosive charge capable of producing a second explosion;

($b_{1-4}$) means for transmitting the second explosion;

($b_{1-5}$) a carried projectile positioned at the other end of said sleeve, said second explosion acting on said carried projectile by means to transmit the second explosion thereby igniting a third explosive charge in said carried projectile.

2. The shell for firing practice in full accordance with claim 1 wherein said means for transmitting the second explosion has at least one means of communication between the second explosive charge and said third explosive charge, said sleeve having a deformation at the other end to hold said carried projectile therein.

3. The shell for firing practice in full accordance with claim 1 wherein the sleeve has a set of side holes in line with the cartridge.

4. The shell for firing practice in full accordance with claim 1 wherein the second firing pin is capable of sliding in said sleeve, the range of sliding being limited by a pin housed in said sleeve.

5. The shell for firing practice in full accordance with claim 2 wherein the means for transmitting the second explosion is comprised of several successive layers of felt discs which are separated from one another by discs made from a stiffer material than said felt.

6. THe shell for firing practice in full accordance with claim 1 wherein the outside of the sleeve is provided with a number of lugs to attach it to the master projectile.

7. The shell for firing practice in full accordance with claim 1 wherein the outside of the sleeve is provided with a screwed thread for the purpose of attaching it to a master projectile.

8. The shell for firing practice in full accordance with claim 1 wherein said master projectile has a nose section and a tail section and the bore of the master projectile has a groove positioned at the nose end of said master projectile which allows the master projectile to be withdrawn from the mortar.

9. The shell for firing practice in full accordance with claim 1 wherein the master projectile has a number of slots in said bore which enable the sleeve to be fitted and secured to said master projectile, said master projectile further comprising a screw to lock the sleeve in position in said bore.

10. The shell for firing practice in full accordance with claim 1 further comprising ring shaped pieces for the purpose of being placed between the body of the master projectile and the fins thereof.

* * * * *